US005746076A

United States Patent [19]

Inoue

[11] Patent Number: 5,746,076

[45] **Date of Patent: *May 5, 1998**

[54] DOOR LOCK ACTUATOR UNIT

[75] Inventor: Jiro Inoue, Yamanashi-ken, Japan

[73] Assignee: Mitsui Kinzoku Kogyo Kabushiki Kaisha, Tokyo, Japan

[ * ] Notice: The term of this patent shall not extend beyond the expiration date of Pat. No. 5,582,448.

[21] Appl. No.: 559,943

[22] Filed: Nov. 17, 1995

[30] Foreign Application Priority Data

Nov. 21, 1994 [JP] Japan ..... 6-311116

[51] Int. Cl.[6] ..... E05B 47/00

[52] U.S. Cl. ..... 70/277; 292/201; 292/216; 292/DIG. 23

[58] Field of Search ..... 70/275, 277–282, 70/264, 237–240; 292/DIG. 23, DIG. 38, 144, 201, 216, 336.3, 337

[56] References Cited

U.S. PATENT DOCUMENTS

| | | | |
|---|---|---|---|
| 5,028,084 | 7/1991 | Fukumoto et al. | 292/337 |
| 5,035,453 | 7/1991 | Fukumoto et al. | 292/216 X |
| 5,035,454 | 7/1991 | Fukumoto et al. | 292/DIG. 23 X |
| 5,071,179 | 12/1991 | Brackmann | 292/DIG. 23 X |
| 5,072,975 | 12/1991 | Hamada et al. | 292/201 |
| 5,240,296 | 8/1993 | Kobayashi | 292/201 |
| 5,261,711 | 11/1993 | Mizuki et al. | 292/201 |
| 5,338,076 | 8/1994 | Tanaka | 292/201 X |
| 5,503,441 | 4/1996 | Schwaiger | 292/DIG. 23 X |
| 5,516,164 | 5/1996 | Kobayashi | 292/DIG. 23 X |
| 5,516,167 | 5/1996 | Hayakawa et al. | 292/DIG. 23 X |
| 5,564,308 | 10/1996 | Hoshikawa et al. | 292/201 X |
| 5,582,448 | 12/1996 | Inoue | 292/201 X |
| 5,603,537 | 2/1997 | Amano et al. | 292/DIG. 23 X |

FOREIGN PATENT DOCUMENTS

| | | | |
|---|---|---|---|
| 478013 | 4/1992 | European Pat. Off. | 292/DIG. 23 |
| 2254880 | 10/1992 | United Kingdom | 292/DIG. 23 |

*Primary Examiner*—Suzanne Dino
*Attorney, Agent, or Firm*—Browdy and Neimark

[57] ABSTRACT

An actuator unit for shifting a lock lever of a vehicle door lock device between a locked position and an unlocked position comprises a housing having a reversible motor, an inside lever disposed inside the housing and being shiftable by the motor, and a key lever disposed inside the housing. The inside lever has a first shaft whose outer end extends through the housing and is connected to the lock lever. The key lever has a second shaft whose outer end extends through the housing and is connected to a door key cylinder. The first and second shafts being coaxial with each other but protruding in opposite directions. The inside lever has a third shaft coaxial with the first shaft and the key lever has a hole for supporting the third shaft. The actuator unit has first detecting means provided inside the housing for detecting a position of the inside lever, and second detecting means provided inside the housing for detecting a position of the key lever.

9 Claims, 4 Drawing Sheets

FIG.8
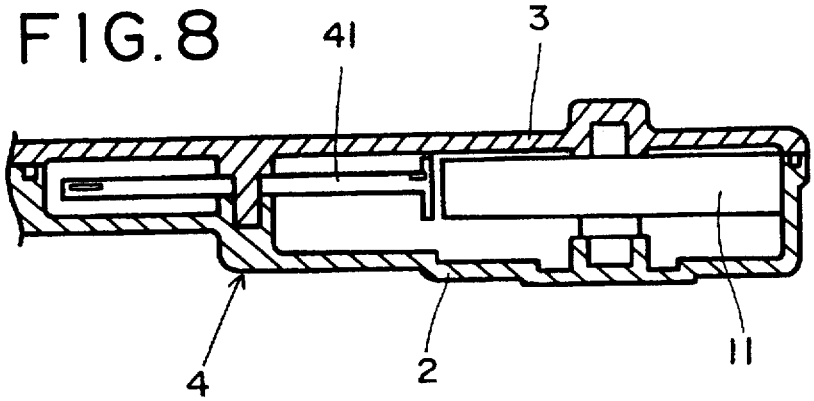
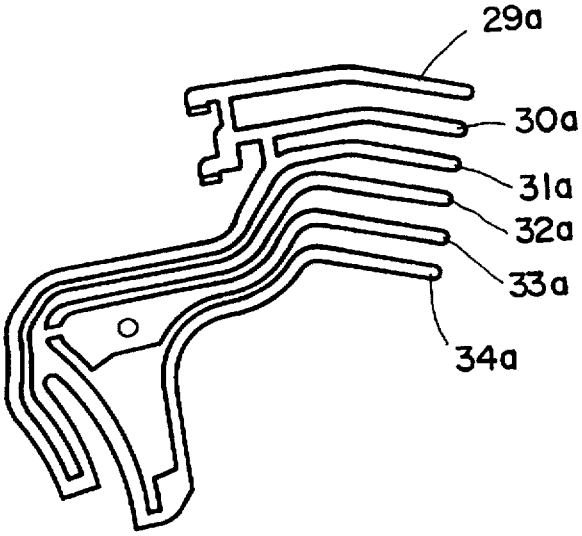
FIG.9
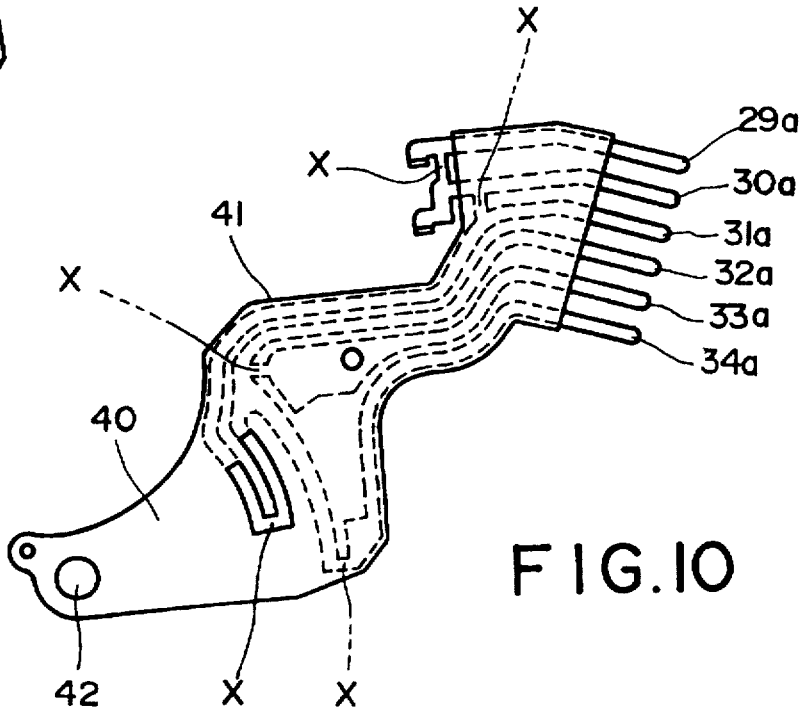
FIG.10

DOOR LOCK ACTUATOR UNIT

BACKGROUND OF THE INVENTION

1. Field of the Invention

The present invention relates to an actuator for shifting a lock lever of a vehicle door lock device between a locked position and an unlocked position.

2. Description of the Related Art

Most vehicle door lock devices used today are controlled by central door locking systems. With a typical central door locking system, the switching of the driver's door lock device to a locked state (or an unlocked state) causes the remaining door lock devices to switch to the locked state (or the unlocked state). The door lock device adapted to the central door locking system needs to employ at a least first detecting means for detecting a position of a lock lever which changes the door lock device between the locked state and the unlocked state, second detecting means for detecting a position of a door key cylinder; and an actuator (a reversible motor) for shifting the lock lever between the locked position and the unlocked position (described in, for example, U.S. Pat. No. 5,028,084).

Since the first and second detecting means normally employ microswitches, electrically conductive cables are needed to connect the switches of the two detecting means to a controller of the central door locking system and to connect the motor to the controller. Such cabling increases the costs for component parts and their assembly. In addition, since the microswitches need waterproofing to prevent short-circuiting by water coming in through gaps of a door structure, the costs for the switches become high.

A door lock device according to U.S. Pat. No. 5,028,084 comprises a brush-type switch disposed in a housing of the actuator as the first detecting means, and an expensive waterproof microswitch as the second detecting means. The switch of the second detecting means has to be disposed outside the actuator housing and therefore needs waterproofing because this construction employs no member, that is connected to the door key cylinder, provided in the actuator housing.

SUMMARY OF THE INVENTION

Accordingly, it is an object of the present invention to provide a low-cost actuator unit for a door lock device comprising a housing and switches corresponding to the first and second detecting means provided inside the housing.

It is another object of the invention to provide a simple-structured actuator unit wherein its housing contains an inside lever connected to the lock lever and a key lever connected to the door key cylinder.

It is still another object of the invention to provide an actuator unit wherein the supporting structure for the inside lever and key lever disposed inside the housing is simplified.

It is a further object of the invention to provide an actuator unit wherein the supporting structure for the circuit plate having conductive pieces is simplified.

BRIEF DESCRIPTION OF THE DRAWINGS

The foregoing and further objects, features and advantages of the present invention will become apparent from the following description of preferred embodiments with reference to the accompanying drawings, wherein:

FIG. 8 is sectional view showing a mounting of the circuit plate;

FIG. 9 is a plan view of conductive pieces with their ends interconnected; and

FIG. 10 a plan view of the conductive pieces covered with resin.

DETAILED DESCRIPTION OF PREFERRED EMBODIMENTS

Preferred embodiments of the present invention will be described hereinafter with reference to the accompanying drawings.

Figure 1:
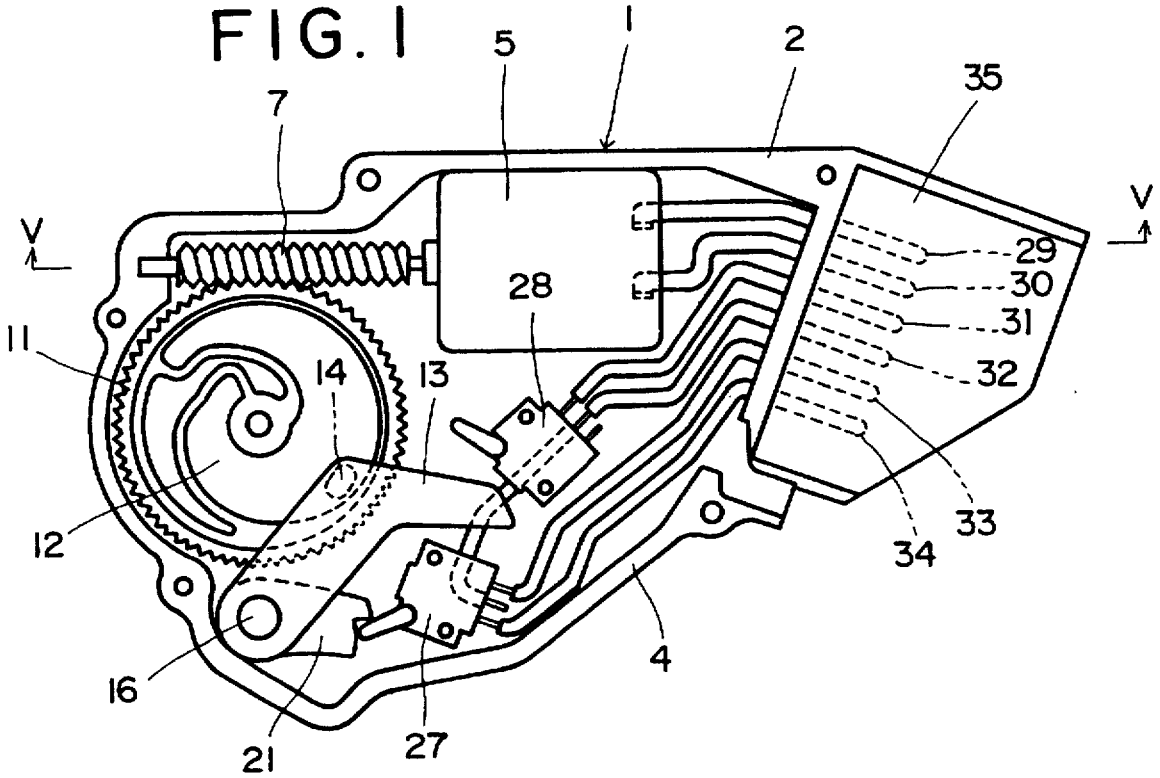
FIG. 1 is a plan view showing an internal structure of an actuator unit for the door lock device according to a first embodiment of the present invention.
Figure 2:
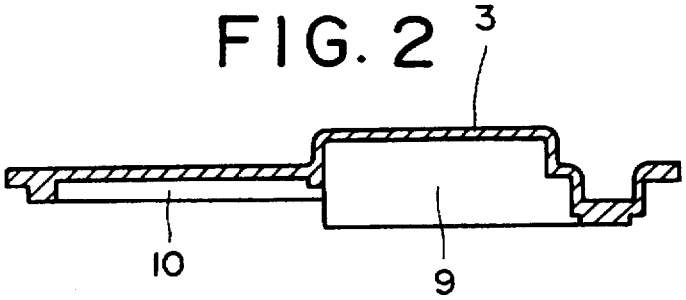
FIG. 2 is a sectional view of a cover case of an actuator housing according to the first embodiment.
Figure 3:
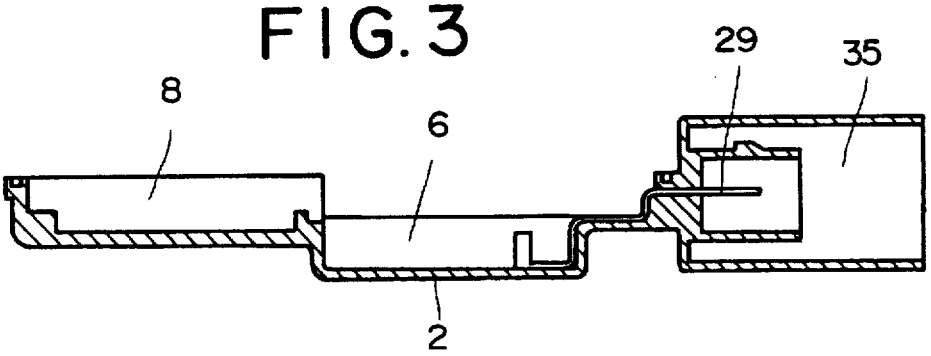
FIG. 3 is a sectional view of a main case of the actuator housing according to the first embodiment.

Referring to FIGS. 1, 2 and 3, an actuator unit 1 according to the first embodiment of the present invention has a synthetic resin-made housing 4 essentially composed of a main case 2 and a cover case 3 which is fastened to the main case 2 by screws (not shown) or the like. The main case 2 has a first recess 6 for receiving a lower portion of a reversible motor 5 and a second recess 8 for receiving a lower portion of a cylindrical worm gear 7, as shown in FIG. 3. The cover case 3 has a third recess 9 for receiving an upper portion of the motor 5 and a fourth recess 10 for receiving an upper portion of the worm gear 7, as shown in FIG. 2.

A worm wheel 11 which is meshed with the worm gear 7 has a cam groove 12 formed in an upper surface thereof. The worm wheel 11 is returned to its neutral position by an elastic restoration force of a spring (not shown) when the motor 5 is not energized. A synthetic resin-made inside lever 13 which is provided near the worm wheel 11 has a protrusion 14 engaged with the cam groove 12, a long shaft 16 protruding outward from an opening 15 formed in housing 4 (see FIG. 4), and a short shaft 17 coaxial with the long shaft 16. The short shaft 17 and the long shaft 16 protrude in opposite directions. The outside end of the long shaft 16 is fixed to an auxiliary lever 19 that is connected to a lock lever 18, which is known in the conventional art. When the worm wheel 11 is turned in either direction by the motor 5, engagement of the cam groove 12 with the protrusion 14 causes the inside lever 13 to accordingly turn about the shaft 16, so as to shift the lock lever 18 from a locked position to an unlocked position, and vice versa, as in the conventional art.

As is known in the conventional art, the lock lever 18 is connected to an inside lock knob 20 disposed in the interior surface of the door. When the lock lever 18 turns due to an operation of the lock knob 20, the inside lever 13 also turns about the shaft 16. However, at this time, the worm wheel 11 does not rotate because of a lost-motion provided between the protrusion 14 of the inside lever 13 and the cam groove 12 of the worm wheel 11.

Figure 4:
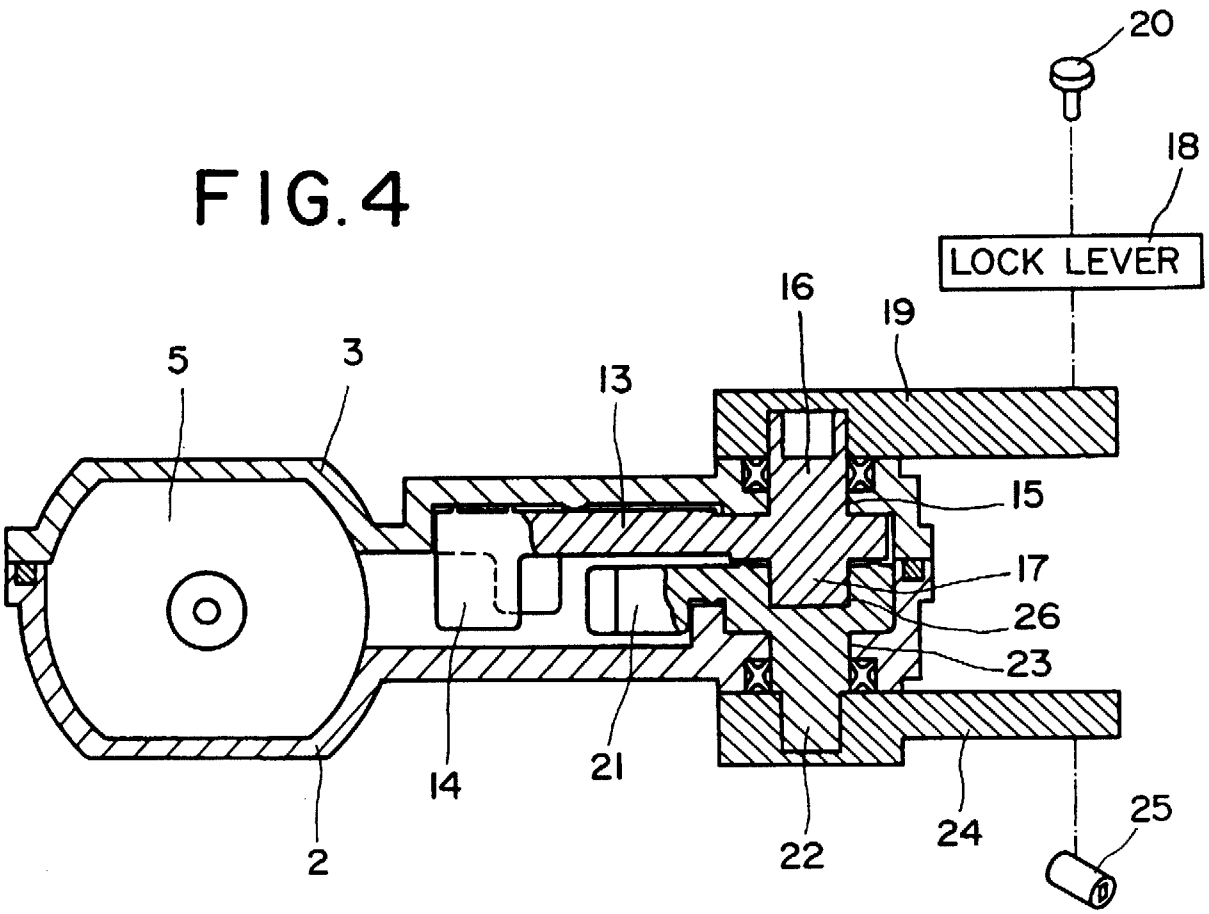
FIG. 4 is a schematic sectional view taken along line IV—IV of FIG. 1 showing a supporting structure for an inside lever and a key lever.
Figure 5:
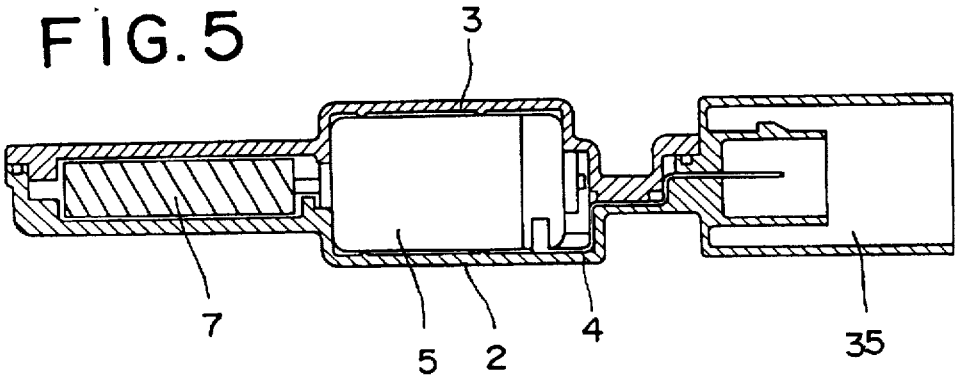
FIG. 5 is a sectional view taken along line V—V of FIG. 1.
Figure 6:
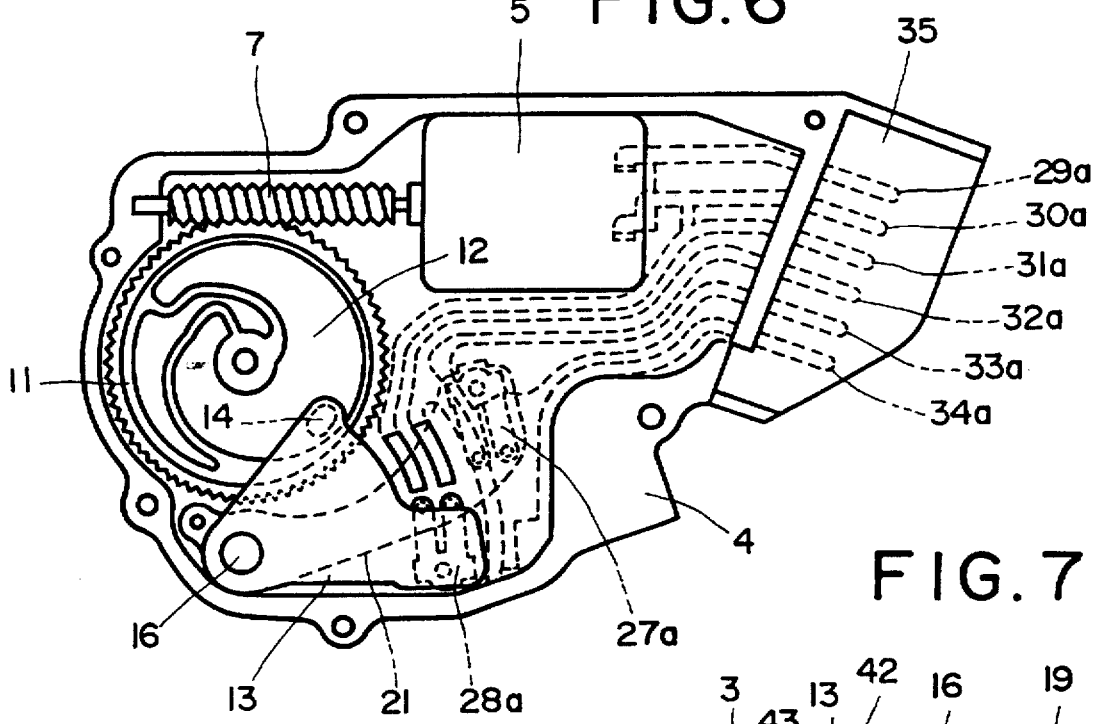
FIG. 6 is a plan view showing an internal structure of an actuator unit for the door lock device according to a second embodiment of the present invention.

A synthetic resin-made key lever 21 is disposed under the inside lever 13. As shown in FIG. 4, a shaft 22 of the key lever 21 protrudes downward through an opening 23 formed in housing 4. A lower end of the shaft 22 is fixed to an auxiliary lever 24 that is connected to a door key cylinder 25 by a rod or the like. A cylindrical hole 26 is formed in the upper surface of the key lever 21. The hole 26 is coaxial with the shaft 22 and receives the short shaft 17 of the inside lever 13. Therefore, three shafts 16, 17 and 22 are coaxial with each other and act as a single linear shaft supporting the two levers 13 and 21. This construction eliminates a separate shaft member to support the levers 13, 21.

The inside lever 13 and the key lever 21 are not engaged but pivotable independently of each other. Accordingly, if the key lever 21 is turned by operating the key cylinder 25, the inside lever 13 (or the lock lever 18) will not turn in a mechanical sense.

Further provided inside the housing 4 are a micro-switch 27 for detecting a position of the key lever 21 pivotable by the key cylinder 25, and another microswitch 28 for detecting a position of the inside lever 13 connected rigidly to the lock lever 18, as shown in FIG. 1. Ends of conductive pieces 29 and 30 for the motor 5, ends of conductive pieces 31 and 32 for the microswitch 28, and ends of conductive pieces 33 and 34 for the microswitch 27 are exposed externally at a female connector 35 formed in the housing 4. The female connector 35 receives a male connector (not shown) of a controller of a well known central door locking system, so that the controller controls the motor 5 on the basis of data or signals from the two microswitches 27, 28. The control process of the controller is irrelevant to the invention and will not be described. Since the switches and conductive pieces are disposed in the actuator housing 4, which is highly water-tight, no other waterproofing measure is needed for the switches and conductive pieces.

FIGS. 6–10 illustrate the second embodiment of the door lock actuator unit of the invention, which facilitates a setting of conductive pieces **29*a*–34*a* and employs inexpensive brush-type switches. According to the second embodiment, the conductive pieces 29*a*–34*a* are formed by pouching a thin plate of copper or phosphor bronze into a shape in which the conductive pieces are interconnected at their ends as shown in FIG. 9. The still-connected conductive pieces are partially enclosed in a synthetic resin 40 by insert-molding in such a manner that predetermined portions are exposed. The extraneous portions (connecting portions) indicated by X in FIG. 10 are removed from the conductive pieces by press processing. A circuit plate 41 having the conductive pieces 29*a*–34*a* is thus formed. Such circuit plates can be easily produced on a large scale, reducing production costs. In addition, the use of connected conductive pieces instead of mounting the individual conductive pieces separately in the housing 4** reduces the costs for assembly.

Figure 7:
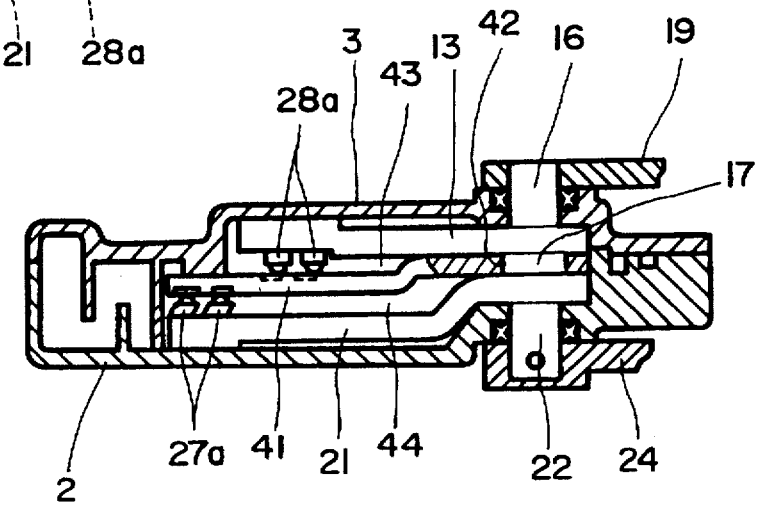
FIG. 7 is a sectional view showing a mounting of an inside lever, a key lever and a circuit plate according to the second embodiment.

The circuit plate 41 is disposed between the inside lever 13 and the key lever 21 as shown in FIG. 7. The circuit plate 41 has an opening 42 through which the short shaft 17 of the inside lever 13 is inserted. Since the circuit plate 41 is supported by a portion of the shaft that supports the levers 13 and 21, the number of screws or other component parts for fastening the circuit plate 41 to the housing 4 can be reduced.

A brush **27*a* corresponding to the microswitch 27 in the first embodiment is fixed to the key lever 21 and a brush 28*a* corresponding to the microswitch 28 is fixed to the inside lever 13. The brushes 27*a* and 28*a* are electrically connected to two of the conductive pieces 29*a*–34*a* to detect the positions of the levers 13 and 21. As shown in FIG. 7, the brushes 27*a*, 28*a* respectively contact the opposite surfaces of the circuit plate 41. This construction allows for reduction of a clearance 43 between the inside lever 13 and the circuit plate 41 and a clearance 44 between the key lever 21 and the circuit plate 41 and, accordingly, reduction of the heights of the brushes 27*a*, 28*a*. Thus, stable contact can be maintained between the brushes 27*a*, 28*a*** and the conductive pieces.

While the present invention has been described with reference to what are presently considered to be preferred embodiments thereof, it is to be understood that the invention is not limited to the disclosed embodiments. To the contrary, the invention is intended to cover various modifications and equivalent arrangements included within the spirit and scope of the appended claims.

What is claimed is:

1. An actuator unit for shifting a lock lever of a vehicle door lock device between a locked position and an unlocked position, comprising:

a housing containing a reversible motor;

an inside lever disposed inside the housing and being shiftable by the reversible motor, said inside lever having a first shaft whose outer end extends through the housing and is connected to the lock lever substantially without any lost motion permitting a movement of the inside lever to be transmitted to the lock lever by way of the first shaft and vice versa;

first detecting means provided inside the housing for detecting a position of the inside lever cooperatively connected to the lock lever;

a key lever disposed inside the housing, said key lever having a second shaft whose outer end extends through the housing and is connected to a door key cylinder permitting a movement of the door key cylinder to be transmitted to the key lever by way of the second shaft;

second detecting means provided inside the housing for detecting a position of the key lever cooperatively connected to the door key cylinder and for outputting a signal to operate the reversible motor in one of the operating directions;

a plurality of conductive pieces each having a first end connected to at least one of the reversible motor, the first detecting means and the second detecting means; and a connector to which a second end of each of the conductive pieces is attached;

wherein the first shaft and the second shaft are coaxial and separably rotatable relative to each other.

2. An actuator unit according to claim 1, wherein the key lever and the inside lever are pivotable independently of each other.

3. An actuator unit according to claim 1, wherein the first shaft and the second shaft protrude in opposite directions, and wherein one of the inside lever and the key lever has a third shaft coaxial with the first shaft and the second shaft, and the other one has a hole for supporting the third.

4. An actuator unit according to claim 3, wherein each of the first shaft and the second shaft has no portion overlapping the third shaft.

5. An actuator unit for shifting a lock lever of a vehicle door lock device between a locked position and an unlocked position, comprising:

a housing containing a reversible motor;

an inside lever disposed inside the housing and being shiftable by the reversible motor, said inside lever having a first shaft whose outer end extends through the housing and is connected to the lock lever substantially without any lost motion;

first detecting means provided inside the housing for detecting a position of the inside lever cooperatively connected to the lock lever;

a key lever disposed inside the housing, said key lever having a second shaft whose outer end extends through the housing and is connected to a door key cylinder;

second detecting means provided inside the housing for detecting a position of the key lever cooperatively connected to the door key cylinder and for outputting a signal to operate the reversible motor in one of the operating directions;

a plurality of conductive pieces each having a first end connected to at least one of the reversible motor, the first detecting means and the second detecting means; and a connector to which a second end of each of the conductive pieces is attached;

wherein the conductive pieces are fixed in a synthetic resin-made circuit plate;

wherein the circuit plate is disposed between the inside lever and the key lever.

6. An actuator unit according to claim 5, wherein one of the inside lever and the key lever has a third shaft while the other of the inside lever and the key lever resectively has a hole for supporting the third shaft, and wherein the circuit plate has a hole into which the third shaft is inserted.

7. An actuator unit according to claim 5, wherein at least two of the plurality of the conductive pieces are exposed on a first side of the circuit plate, and at least two of the plurality of the conductive pieces are exposed on a second side of the circuit plate, and wherein the inside lever has a brush for selectively contacting the conductive pieces exposed on said first side, and wherein the key lever has another brush for selectively contacting the conductive pieces exposed on said second side.

8. An actuator unit according to claim 5, wherein the first detecting means includes a brush switch fixed to the inside lever for connecting two of the conductive pieces, and the second detecting means includes a brush switch fixed to the key lever for connecting two of the conductive pieces.

9. An actuator unit according to claim 5, wherein the conductive pieces of the circuit plate are partially enclosed in a synthetic resin by insert-molding.

* * * * *